US007781971B2

(12) United States Patent
Matsuno et al.

(10) Patent No.: US 7,781,971 B2
(45) Date of Patent: Aug. 24, 2010

(54) CONDUCTIVE COMPOSITION FOR BLACK BUS ELECTRODE, AND FRONT PANEL OF PLASMA DISPLAY PANEL

(75) Inventors: Hisashi Matsuno, Tokyo (JP); Michael F. Barker, Raleigh, NC (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 329 days.

(21) Appl. No.: 11/978,805

(22) Filed: Oct. 29, 2007

(65) Prior Publication Data

US 2009/0033220 A1 Feb. 5, 2009

(30) Foreign Application Priority Data

Aug. 3, 2007 (JP) ..... 2007-202450

(51) Int. Cl.
*H01J 17/49* (2006.01)

(52) U.S. Cl. ..... 313/584; 313/586

(58) Field of Classification Search ..... 313/582–587
See application file for complete search history.

(56) References Cited

U.S. PATENT DOCUMENTS

| | | | | |
|---|---|---|---|---|
| 2,850,445 | A | 9/1958 | Oster | |
| 2,875,047 | A | 2/1959 | Oster | |
| 3,074,974 | A | 1/1963 | Gebura | |
| 3,097,097 | A | 7/1963 | Oster et al. | |
| 3,145,104 | A | 8/1964 | Oster et al. | |
| 3,380,381 | A | 4/1968 | Musgrave | |
| 3,427,161 | A | 2/1969 | Laridon et al. | |
| 3,479,185 | A | 11/1969 | Chambers, Jr. | |
| 3,549,367 | A | 12/1970 | Chang et al. | |
| 4,162,162 | A | 7/1979 | Dueber | |
| 5,032,490 | A | 7/1991 | Nebe et al. | |
| 6,097,149 | A * | 8/2000 | Miyaji et al. | 313/582 |
| 6,156,433 | A * | 12/2000 | Hatori et al. | 428/411.1 |
| 6,577,059 | B2 * | 6/2003 | Shirakawa et al. | 313/506 |
| 6,777,872 | B2 * | 8/2004 | Aoki et al. | 313/582 |
| 2006/0064011 | A1 | 3/2006 | Hong | |
| 2006/0216529 | A1 | 9/2006 | Barker et al. | |
| 2006/0266984 | A1 | 11/2006 | Lee et al. | |
| 2007/0046568 | A1 | 3/2007 | Shim et al. | |

FOREIGN PATENT DOCUMENTS

| | | | |
|---|---|---|---|
| JP | 2002-299832 | A | 10/2002 |
| JP | 3479463 | B2 | 12/2003 |
| JP | 2004-063247 | A | 2/2004 |
| JP | 3548146 | B2 | 4/2004 |
| JP | 2006-086123 | A | 3/2006 |
| JP | 3779297 | B2 | 3/2006 |
| JP | 3854753 | B2 | 9/2006 |

* cited by examiner

*Primary Examiner*—Nimeshkumar D Patel
*Assistant Examiner*—Anne M Hines

(57) ABSTRACT

The black bus electrode of plasma display panel is formed from a conductive composition comprising a conductive powder, glass powder, organic binder, organic solvent, and black pigment, wherein the conductive powder comprises an alloy of at least two metals selected from the group of Ru, Rh, Pd, Ag, Os, Ir, Pt and Au.

10 Claims, 6 Drawing Sheets

CONDUCTIVE COMPOSITION FOR BLACK BUS ELECTRODE, AND FRONT PANEL OF PLASMA DISPLAY PANEL

BACKGROUND OF THE INVENTION

1. Field of the Invention

The present invention relates to an electrode composition for plasma display panels (PDP), and more particularly to improvements in the conductive components included in black bus electrodes.

2. Technical Background

In PDP, black components are included in the bus electrodes of the front panel to improve the contrast. Single- and double-layered types of bus electrodes are known. A black component is included along with a conductive component such as silver in the single-layered type. In the double-layered type, a white electrode containing a conductive component such as silver is stacked with a black electrode (black bus electrode) containing the black component.

Ruthenium oxide, ruthenium compounds (Japanese Patent JP3779297), $Co_3O_4$ (JP3854753), Cr—Cu—Co (US patent publication 2006-0216529), lanthanum compounds (JP3548146), and Cuo—$Cr_2O_3$—$Mn_2O_3$ (JP3479463) are known as useful for black components.

Black components with a high degree of blackness are preferred for improving the contrast in PDP. Blackness is usually assessed as the L value in PDP. Low contact resistance is also an element that is considered important as well as blackness. Because black components have higher resistance than conductive metals such as silver or copper, there has long been a need to find a way to combine the mutually conflicting factors of lower contact resistance and higher blackness to improve contrast.

Ruthenium oxides and ruthenium compounds have a high degree of blackness as the black component and are also conductive, and have conventionally been preferred for use to obtain high blackness and low contact resistance in PDP. However, the development of less expensive materials is needed in order to make the price of PDP more competitive.

Adding a highly conductive, inexpensive metal, for example copper to the black bus electrode and minimizing the amount of the expensive black component may be contemplated in the interests of reducing material costs. However, copper characteristically tends to oxidize, and must therefore be sintered in a reducing atmosphere. Also, nickel has relatively low conductivity. Palladium releases oxygen, particularly during reduction, as a result of the redox reaction during the sintering process, and thus results in a considerable loss of the bus electrode properties.

Ag is a desirable material that is highly conductive and inexpensive, but the Ag atoms are diffused into glass during the sintering process, and a resulting problem is yellowing of the black stripes that are formed (cf. JP3779297). In other words, the addition of Ag to the black bus electrodes formed on the front panel side results in a loss of PDP contrast.

JP2006-86123 has disclosed a technique relating to conductive powder used in PDP electrodes, where a powder comprising silver- or gold-coated with copper, nickel, aluminum, tungsten, or molybdenum is used as a conductive powder in PDP electrodes or green sheets.

JP2002-299832 also discloses a technique in which Pd-containing Ag prepared by co-precipitation is used to form electrodes on a glass substrate. It is claimed that this results in better adhesion between the glass substrate and the electrodes, low resistance, and better migration resistance.

JP2002-299832 is characterized by the use of Ag and Pd co-precipitated powder instead of a mixture of Ag powder and Pd powder or Ag—Pd alloy (Paragraph 0011). PDP electrodes were disclosed as the electrode application. Although the language is not explicit, the electrodes of JP2002-299832 are formed on a glass substrate, and as a result, it may be concluded that address electrodes formed on the rear panel of a PDP are intended in light of the fact that adhesion with glass is claimed (such as Paragraph 0014) as well as the fact that a substrate on which a paste composition (Paragraphs 0059 and 0062), electrodes, barrier walls, and a fluorescent material have been formed is sealed with a front panel (Paragraph 0075).

There is a need for a black bus electrode that has a high degree of blackness and low contact resistance, thereby contributing to the improvement of PDP properties.

SUMMARY OF THE INVENTION

The invention concerns the adding of a small amount of a precious metal alloy powder to a black electrode to enable the formation of a black bus electrode having higher blackness and lower contact resistance, with less Ag-induced yellowing.

Specifically, the present invention is a conductive composition for a plasma display black bus electrode, comprising a conductive powder, glass powder, organic binder, organic solvent, and black pigment, wherein the conductive powder comprises an alloy of at least two metals selected from the group consisting of Ru, Rh, Pd, Ag, Os, Ir, Pt and Au.

The present invention is also a front panel of a plasma display panel on which bus electrodes are formed, wherein the bus electrode has a black-and-white double-layered structure comprising a black electrode and a white electrode, and the black electrode comprises an alloy of at least two metals selected from the group consisting of Ru, Rh, Pd, Ag, Os, Ir, Pt and Au as a conductive component.

The conductive composition of the present invention is used to form a black bus electrode that has a high degree of blackness and low contact resistance. It was evident that the alloy of the present invention provided low contact resistance even when added in low amounts.

BRIEF DESCRIPTION OF THE DRAWING(S)

FIG. 1 is a perspective expansion plan schematically illustrating an AC plasma display panel device;

FIG. 2 illustrates a series of processes for producing double-layered bus electrodes on a glass substrate with transparent electrodes, with each figure illustrating (A) the stage where a paste for forming black bus electrodes is applied, (B) the stage where a paste for forming white electrodes is applied, (C) the stage where a given pattern is exposed to light, (D) the development stage, and (E) the sintering stage; and FIG. 3 is a graph of the changes in weight as a result of the redox reaction of Ag—Pd co-precipitated powder.

DETAILED DESCRIPTION OF THE INVENTION

Figure 1:
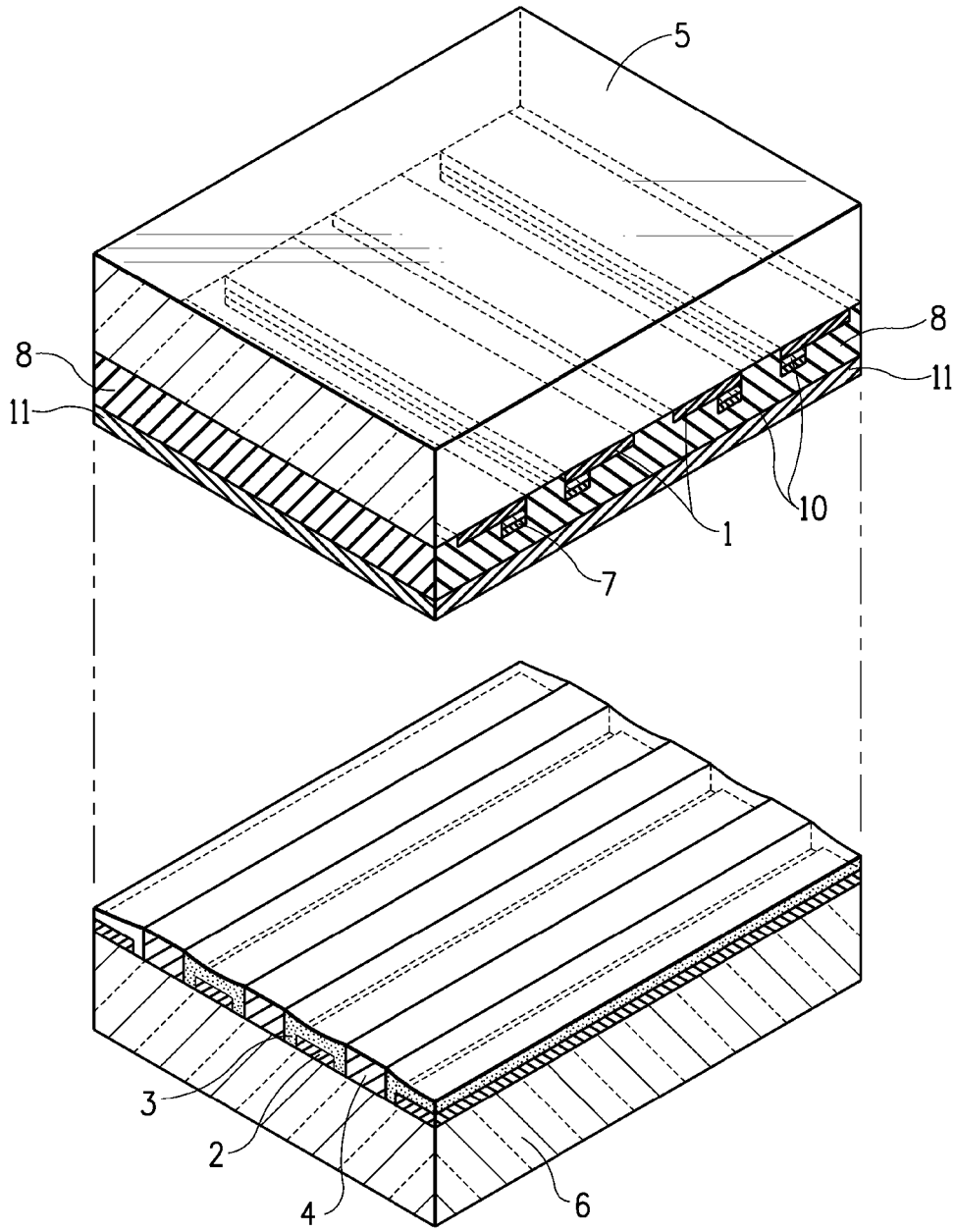

The present invention provides a composition that is used for black electrodes in cases where the bus electrode is the double-layered type comprising a white electrode and black electrode. In the present application, black electrodes of the double-layered type are described as black bus electrodes.

A first embodiment of the invention relates to a conductive composition for a plasma display black bus electrode, comprising a conductive powder, glass powder, organic binder, organic solvent, and black pigment, wherein the conductive powder comprises an alloy of at least two metals selected from the group consisting of Ru, Rh, Pd, Ag, Os, Ir, Pt and Au.

The conductive composition of the invention is ordinarily in the form of a paste.

(A) Conductive Powder

The conductive powder is added for vertical (the direction in which the electrodes are stacked) conduction in black bus electrodes. The conductive composition of the present invention contains an alloy of precious metal as a conductive component. Specifically, at least two metals selected from the group consisting of Ru, Rh, Pd, Ag, Os, Ir, Pt and Au is included in the alloy. These metals are to be included in the alloy at preferably more than 70 atom %, more preferably more than 80 atom %, still more preferably more than 90 atom %, and most preferably 100 atom %, except impurities, in order to prevent possible bad influences caused by additional components such as oxidation. However, in case that better effect is brought by additional components, such addition may be adopted.

The alloy of precious metal includes, but is not limited to, Ag—Pd alloy, Ag—Pt alloy, Ag—Pt—Pd alloy, Pt—Pd alloy. In terms of cost and effect, the alloy is preferably Ag—Pd alloy, Ag—Pt—Pd alloy or Pt—Pd alloy, and more preferably Ag—Pd alloy.

In some cases, conductive particles of gold, platinum, or the like may be added, but from the standpoint of minimizing the number of materials that are used and avoiding expense it is preferable to use the above alloys as the conductive powder.

The configuration of the conductive powder is not particularly limited, and may be in the form of spherical particles or flakes (rods, cones, or plates).

The mean particle diameter (PSD D50) of the conductive powder is preferably 0.1 to 5 μm. Using too small of a particle diameter tends to result in greater contact resistance, making it necessary to increase the amount of the alloy that is added. Using too great a particle diameter tends to result in higher costs and poses the danger of damage due to the substantial protrusion of particles at the surface where the electrode is formed. Here, the mean particle diameter (PSD D50) means the particle diameter corresponding to 50% of the integrated value of the number of particles when the particle size distribution is prepared. The particle size distribution can be prepared using a commercially available measuring device such as the X100 by Microtrac.

To ensure conductivity, the mean particle diameter (PSD D50) of the conductive powder is preferably 0.8 to 2.0 times, more preferably 1.0 to 1.8 times, still more preferably 1.0 to 1.6 times the thickness of the sintered film of the black bus electrodes that are formed. In black bus electrodes, the current flows in the direction, in which the white and black electrodes are stacked, on account of the PDP structure. When the bus electrodes are formed on an ITO electrode, the current flows in the direction from the ITO electrode→black bus electrode→white electrode. The conductive powder is therefore preferably capable of ensuring conductivity in that direction. When the mean particle diameter of the conductive powder is more than 1.0 times the thickness of the sintered film of the black bus electrode that is formed, most of the conductive powder will be in contact with both the white electrode and the transparent electrode such as the ITO electrode. In this case the contact resistance will be low. The above tendency is significant in case of Ag—Pd alloy. The upper limit of the mean particle size is not restricted in terms of contact resistance; however, large particles can cause some problems like wash-off of the particle during manufacturing process.

The present invention involves the use of the precious-metal alloy, where a relatively low sintering temperature can be employed. JP2002-299832 discloses that "because of its high sintering temperature, Ag—Pd alloy cannot be sintered to a glass substrate at a temperature of 600° C. or below" (Paragraph 0003). When used as an ordinary electrode, the conductive components of an electrode are preferred to be thoroughly sintered. In black bus electrodes, on the other hand, the current flows in the perpendicular direction, as noted previously, and conductivity in the vertical direction can be achieved without exposing the Ag—Pd to high temperatures. In some cases it is better to avoid exposure to high temperature sintering processes, so as to prevent the diffusion of Ag. The present invention allows a fully functional electrode to be produced without the use of a high temperature sintering process.

X-ray diffraction will make it possible to determine whether a conductive powder is an alloy or is a mixture of two or more metals. For example, in case of Ag/Pd, when Ag and Pd are not alloyed, the peak characteristic of Ag and the peak characteristic of Pd will each be observed. When alloyed, on the other hand, an alloy peak will be observed between where the Ag peak should be and where the Pd peak should be, depending on the proportion of the Ag and Pd.

Figure 3:
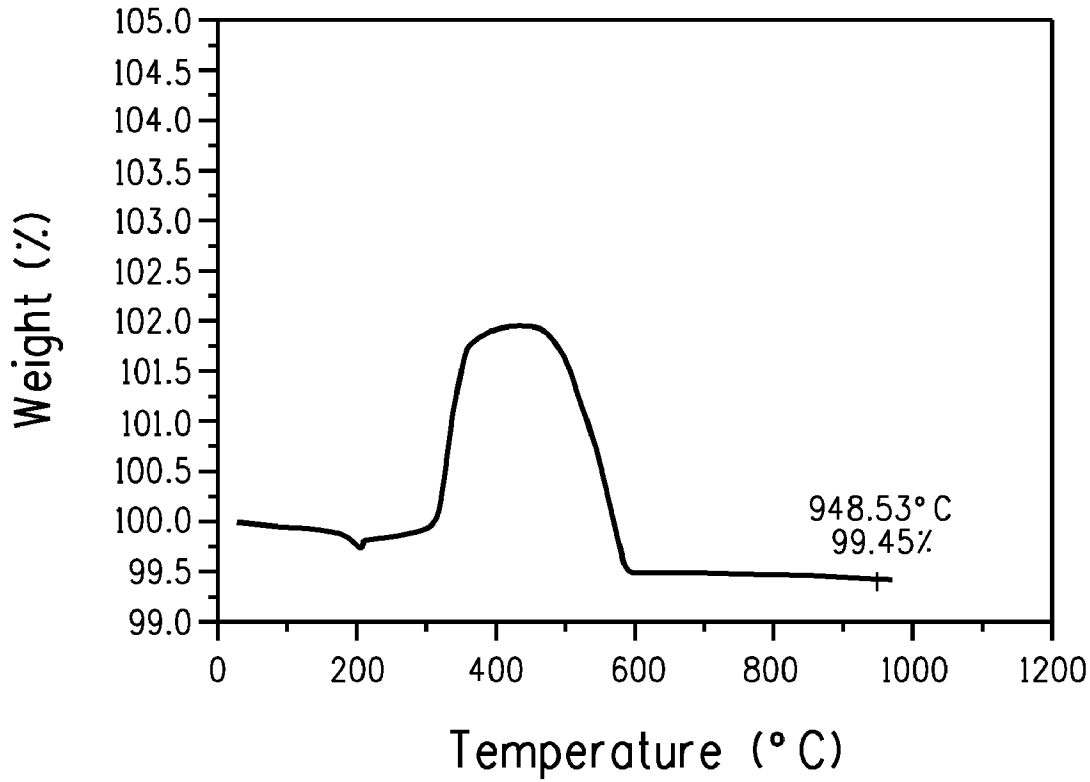

Because precious metal such as palladium is added in the form of an alloy in the present invention, it is possible to lower the inherent redox properties of metal. For example, palladium releases oxygen, particularly during reduction, as a result of the redox reaction during the sintering process, and thus results in a considerable loss of the bus electrode properties. This will be elaborated on in greater detail. FIG. 3 relates to the behavior of Ag 80/Pd 20 co-precipitated powder, which, as illustrated in FIG. 3, is such that oxidation progresses at around 300 to 350° C. when the Ag/Pd co-precipitated powder is heated, resulting in the increase in weight and volume, and when the powder is further heated reduction progresses at around 500 to 600° C., resulting in the release of oxygen, with a loss of weight and volume. Because the silver in the white electrode becomes sintered at 500 to 600° C. during the PDP manufacturing process, the oxygen that is released becomes trapped in the black bus electrodes, without being released through the white electrodes. As the oxygen gas naturally takes up considerable volume, the electrode film may end up expanding where the released oxygen is present as a result of the redox reaction. Another problem is that the portions where the oxygen is trapped may be perceived as defects when viewed from the display surface. However, this can be avoided in the present invention.

A process for sintering the TOG forming the dielectric is required after the electrode formation in the PDP manufacturing process, but an unexpected effect is that the contact resistance is lowered after the TOG sintering process.

During the production of the PDP, the paste for producing the black stripes and the paste for producing the black bus electrodes may sometimes be the same, as disclosed in JP2004-063247A, and the present invention is particularly useful when such a process is adopted. When Ag is included in the black stripes, yellowing caused by the diffusion of Ag can become a particular problem, but the use of the alloy in the present invention prevents such Ag diffusion-induced yellowing.

Regarding Ag—Pd alloy, cost is an advantage in the use of Ag—Pd alloy. Material costs can be controlled by using Ag—Pd alloy, which is a relatively inexpensive metal compared to ruthenium, platinum, gold, and the like. However, the present invention is not limited to Ag—Pd alloy.

The alloy proportions for the alloy are not particularly limited. Depending on used alloys, the alloy proportion is determined. For example, silver and palladium tend to become alloyed no matter what the proportion in which they are blended. Since palladium has a higher melting point, a higher proportion of palladium will be more likely to prevent the diffusion of silver at elevated temperatures. In other words, yellowing will be more satisfactorily prevented the greater the proportion of the palladium. However, since palladium is more expensive than silver, a lower palladium content is preferable from the standpoint of cost. A Ag:Pd alloy with wt % Pd preferably between 5 and 30%, more preferably between 10 and 25% is used.

The alloys of the present invention can be produced by well known methods in the art. Commercially available alloys may also be used.

The alloy content is preferred to be 0.01 to 5 wt %, preferably 0.05 to 2.0 wt %, and more preferably 0.2 to 1.5 wt % based on the total amount of the composition. In black bus electrodes, the content of the conductive particles may be extremely low since there is no need for horizontal conduction to be taken into account. The amount of the alloy is preferred to be lower from the standpoint of controlling the costs associated with the alloys. However, enough of the alloy is to be added to bring about the effects of the alloy.

(B) Glass Powder (Glass Frit)

A glass powder is used as a binder in the present invention to promote sintering of the conductive powder or black pigment components in the black bus electrodes. The glass powder used in the invention is not particularly limited. Powder with sufficiently low softening point to ensure adhesion with the substrate is normally used.

The softening point of the glass powder is normally to be 325 to 700° C., preferably 350 to 650° C., and more preferably 375 to 600° C. If melting takes place at a temperature lower than 325° C., the organic substances will tend to become enveloped, and subsequent degradation of the organic substances will cause blisters to be produced in the paste. A softening point over 700° C., on the other hand, will weaken the paste adhesion and may damage the PDP glass substrate.

Types of glass powder include bismuth-based glass powder, boric acid-based glass powder, phosphorus-based glass powder, Zn—B based glass powder, and lead-based glass powder. The use of lead-free glass powder is preferred in consideration of the burden imposed on the environment.

Glass powder can be prepared by methods well known in the art. For example, the glass component can be prepared by mixing and melting raw materials such as oxides, hydroxides, carbonates etc, making into a cullet by quenching, followed by mechanical pulverization (wet or dry milling). There after, if needed, classification is carried out to the desired particle size.

The specific surface area of the glass powder is preferably to be no more than 10 $m^2/g$. At least 90 wt % of the glass powder is preferred to have a particle diameter of 0.4 to 10 μm.

The glass powder content is preferably to be 10 to 50 wt %, based on the total amount of the composition. A proportion of glass powder within this range will ensure bonding with the adjacent PDP constituents, thereby ensuring the formation of sufficiently strong black bus electrodes.

(C) Organic Binder

An organic binder is used to allow constituents such as the conductive powder, glass powder, and black pigment to be dispersed in the composition. The organic binder is burned off.

When the composition of the invention is used to produce a photosensitive composition, the development in an aqueous system is preferred to be taken into consideration in selecting the organic binder. One with high resolution is preferred to be selected.

Examples of organic binders include copolymers or interpolymers prepared from (1) non-acidic comonomers containing $C_1$ to $C_{10}$ alkyl acrylates, $C_1$ to $C_{10}$ alkyl methacrylates, styrene, substituted styrene, or combinations thereof, and (2) acidic comonomers containing ethylenic unsaturated carboxylic acid-containing components. When acidic comonomers are present in the electrode paste, the acidic functional groups will permit development in aqueous bases such as 0.8% sodium carbonate aqueous solution. The acidic comonomer content is preferred to be 15 to 30 wt %, based on the polymer weight.

A lower amount of acidic comonomer may complicate the development of the applied electrode paste on account of aqueous bases while too much acidic comonomer may reduce stability of the paste under a development condition, thereby resulting in only partial development in the areas where images are to be formed.

Suitable acidic comonomers include (1) ethylenic unsaturated monocarboxylic acids such as acrylic acid, methacrylic acid, or crotonic acid; (2) ethylenic unsaturated dicarboxylic acids such as fumaric acid, itaconic acid, citraconic acid, vinylsuccinic acid, and maleic acid; (3) hemiesters of (1) and (2); and (4) anhydrides of (1) and (2). Two or more kinds of acidic comonomers may be used concurrently. Methacrylic polymers are more desirable than acrylic polymers in consideration of the combustibility in low-oxygen atmospheres.

When the non-acidic comonomer is an alkyl acrylate or alkyl methacrylate noted above, the non-acidic comonomer is preferably 70 to 75 wt %, based on the polymer weight. When the non-acidic comonomer is styrene or substituted styrene, the non-acidic comonomer is preferably about 50 wt %, based on the polymer weight, and the remaining 50 wt % is preferably an acid anhydride such as a hemiester of maleic anhydride. α-methylstyrene is a preferred substituted styrene.

The organic binder can be produced using techniques that are well known in the field of polymers. For example, an acidic comonomer can be mixed with one or more copolymerizable non-acidic comonomers in an organic solvent having a relatively low boiling point (75 to 150° C.) to obtain a 10 to 60% monomer mixture. Polymerization is then brought about by adding a polymerization catalyst to the resulting monomer. The resulting mixture is heated to the reflux temperature of the solvent. When the polymer reaction is substantially completed, the resulting polymer solution is cooled to room temperature to recover a sample.

The molecular weight of the organic binder is not particularly limited, but is preferably less than 50,000, more preferably less than 25,000, and even more preferably less than 15,000.

When the conductive composition of the invention is applied by screen printing, the Tg (glass transition temperature) of the organic binder is preferred to be over 90° C. Binders with a Tg below that temperature generally result in a highly adhesive paste when the electrode paste is dried at the usual temperature of 90° C. or below after screen printing. A lower glass transition temperature can be used for materials that are applied by means other than screen printing.

The organic binder content is preferably 5 to 25 wt %, based on the total amount of the composition.

(D) Organic Solvent

The primary purpose for using an organic solvent is to allow the dispersion of solids contained in the composition to be readily applied to the substrate. The organic solvent is preferably one that allows the solids to be dispersed while maintaining suitable stability. Secondly, the rheological properties of the organic solvent preferable endows the dispersion with favorable application properties.

The organic solvent may be a single component or a mixture of organic solvents. The organic solvent that is selected is preferred to be one in which the polymer and other organic components can be completely dissolved. The organic solvent that is selected is preferred to be inert to the other ingredients in the composition. The organic solvent is preferred to have sufficiently high volatility, and is preferred to be able to evaporate off from the dispersion even when applied at a relatively low temperature in the atmosphere. It is preferred that the solvent not be so volatile that the paste on the screen will rapidly dry at ordinary temperature during the printing process.

The boiling point of the organic solvent at ordinary pressure is preferred to be no more than 300° C., and preferably no more than 250° C.

Specific examples of organic solvents include aliphatic alcohols and esters of those alcohols such as acetate esters or propionate esters; terpenes such as turpentine, α- or β-terpineol, or mixtures thereof; ethylene glycol or esters of ethylene glycol such as ethylene glycol monobutyl ether or butyl cellosolve acetate; butyl carbitol or esters of carbitol such as butyl carbitol acetate and carbitol acetate; and Texanol (2,2,4-trimethyl-1,3-pentanediol monoisobutyrate).

The organic solvent content is preferred to be 10 to 40 wt %, based on the total amount of the composition.

(E) Black Pigment

Black pigment is used to ensure the blackness of the black bus electrode.

The black pigment of the electrode paste in the present invention is not particularly limited. Examples include $Co_3O_4$, chromium-copper-cobalt oxides, chromium-copper-manganese oxides, chromium-iron-cobalt oxides, ruthenium oxides, ruthenium pyochlore, lanthanum oxides (ex. $La_{1-x}Sr_xCoO_3$), manganese cobalt oxides, and vanadium oxides (ex. $V_2O_3$, $V_2O_4$, $V_2O_5$). $Co_3O_4$ (tricobalt tetroxide) is preferred in consideration of the burden imposed on the environment, material costs, the degree of blackness, and the electrical properties of the black bus electrode. Two or more types may be used.

The black pigment content is preferred to be 6 to 20 wt %, and preferably 9 to 16 wt %, based on the total amount of the composition.

The conductive composition of the invention may contain the following optional components in addition to the above components. When forming microelectrodes, patterns are preferred to be formed using a photosensitive composition.

(F) Photopolymerization Initiator

Desirable photoinitiators will be thermally inactive but produce free radicals when exposed to actinic rays at a temperature of 185° C. or below. Examples include compounds having two intramolecular rings in a conjugated carbocyclic system. More specific examples of desirable photoinitiators include 9,10-anthraquinone, 2-methyl anthraquinone, 2-ethyl anthraquinone, 2-t-butyl anthraquinone, octamethyl anthraquinone, 1,4-naphthoquinone, 9,10-phenanthrenequinone, benzo[a]anthracene-7,12-dione, 2,3-naphthacene-5,12-dione, 2-methyl-1,4-naphthoquinone, 1,4-dimethyl anthraquinone, 2,3-dimethyl anthraquinone, 2-phenyl anthraquinone, 2,3-diphenyl anthraquinone, retenquinone, 7,8,9,10-tetrahydronaphthacene-5,12-dione, and 1,2,3,4-tetrahydrobenzo[a]anthracene-7,12-dione.

Other compounds that may be used include those given in U.S. Pat. Nos. 2,850,445, 2,875,047, 3,074,974, 3,097,097, 3,145,104, 3,427,161, 3,479,185, 3,549,367, and 4,162,162.

The photoinitiator content is preferred to be 0.02 to 16 wt %, based on the total amount of the composition.

(G) Photopolymerizable Monomer

Photopolymerizable monomers are not particularly limited. Examples include ethylenic unsaturated compounds having at least one polymerizable ethylene group.

Such compounds can initiate polymer formation through the presence of free radicals, bringing about chain extension and addition polymerization. The monomer compounds are non-gaseous; that is, they have a boiling point higher than 100° C. and have the effect of making the organic binder plastic.

Desirable monomers that can be used alone or in combination with other monomers include t-butyl (meth)acrylate, 1,5-pentanediole di(meth)acrylate, N,N-dimethylaminoethyl (meth)acrylate, ethylene glycol di(meth)acrylate, 1,4-butanediol di(meth)acrylate, diethylene glycol di(meth)acrylate, hexamethylene glycol di(meth)acrylate, 1,3-propanediol di(meth)acrylate, decamethylene glycol di(meth)acrylate, 1,4-cyclohexanediol di(meth)acrylate, 2,2-dimethylol propane di(meth)acrylate, glycerol di(meth)acrylate, tripropylene glycol di(meth)acrylate, glycerol tri(meth)acrylate, trimethylol propane tri(meth)acrylate, the compounds given in U.S. Pat. No. 3,380,381, the compounds disclosed in U.S. Pat. No. 5,032,490, 2,2-di(p-hydroxyphenyl)-propane di(meth) acrylate, pentaerythritol tetra(meth)acrylate, triethylene glycol diacrylate, polyoxyethyl-1,2-di-(p-hydroxyethyl)propane dimethacrylate, bisphenol A di-[3-(meth)acryloxy-2-hydroxypropyl)ether, bisphenol A di-[2-(meth) acryloxyethyl)ether, 1,4-butanediol di-(3-methacryloxy-2-hydroxypropyl)ether, triethylene glycol dimethacrylate, polyoxypropyl trimethylol propane triacrylate, trimethylol propane ethoxy triacrylate, butylene glycol di(meth)acrylate, 1,2,4-butanediol tri(meth)acrylate, 2,2,4-trimethyl-1,3-pentanediol di(meth)acrylate, 1-phenylethylene-1,2-dimethacrylate, diallyl fumarate, styrene, 1,4-benzenediol dimethacrylate, 1,4-diisopropenyl benzene, 1,3,5-triisopropenyl benzene, monohydroxypolycaprolactone monoacrylate, polyethylene glycol diacrylate, and polyethylene glycol dimethacrylate. Here, "(meth)acrylate" is an abbreviation indicating both acrylate and methacrylate. The above monomers may undergo modification such as polyoxyethylation or ethylation.

The content of the photopolymerizable monomer is preferred to be 2 to 20 wt %.

(H) Additional Components

The paste may also include well-known additional components such as dispersants, stabilizers, plasticizers, stripping agents, defoamers, and wetting agents.

A second embodiment of the invention relates to a front panel of a plasma display panel on which bus electrodes have been formed, wherein the bus electrode has a black-and-white double-layered structure comprising a black electrode and a white electrode, and the black electrode comprises precious metal alloy as a conductive component. The PDP of the invention is preferably an AC plasma display panel (AC PDP).

The second embodiment of the invention will be elaborated in more detail with reference to the figures using an AC PDP manufacturing process as an example. The composition for the black bus electrode is the same, in terms of the conductive particles, glass powder, and the like, as noted above, and therefore will not be further elaborated below.

FIG. 1 illustrates the structure of an AC PDP device with bus electrodes having a two-layer structure. As illustrated in FIG. 1, the front panel of the AC PDP has the following structural elements: glass substrate 5, transparent electrodes 1 formed on the glass substrate 5, black bus electrodes 10 formed on the transparent electrodes 1, and white electrodes 7 formed on the black bus electrodes 10. A dielectric coating layer (transparent overglaze layer) (TOG) 8 and an MgO coating layer 11 are generally formed on the white electrodes 7. The conductive composition of the invention is used to produce the black bus electrodes 10.

The rear panel of the AC PDP has the following structural elements: a dielectric substrate 6, discharge spaces 3 filled with ionized gas, second electrodes (address electrodes) 2 parallel to the transparent electrodes 1, and barrier walls 4 dividing the discharge spaces. The transparent electrodes 1 and second electrodes 2 face each other on either side of the discharge spaces 3.

The black bus electrodes 10 and white electrodes 7 are formed in the following manner. First, a certain pattern is formed through exposure to light. The polymerization reaction will progress in the parts that have been exposed to light, altering the solubility to the developer. The pattern is developed in basic aqueous solution, and the organic parts are then eliminated through sintering at elevated temperature, whereas the inorganic substances are sintered. The black bus electrodes 10 and white electrodes 7 are patterned using the same or very different images. Finally, an electrode assembly comprising sintered, highly conductive black bus electrodes 10 and white electrodes 7 is obtained. The electrode assembly looks black on the surface of the transparent electrodes 1, and the reflection of outside light is suppressed when placed on the front glass substrate. Although illustrated in FIG. 1, the transparent electrodes 1 described below are not necessary when forming the plasma display device of the invention.

A method for producing the bus electrodes on the front panel of the PDP is described in detail below.

As illustrated in FIG. 2, the method for forming the first embodiment of the bus electrode of the invention comprises a series of processes (FIGS. 2A through 2E).

The transparent electrodes 1 are formed on the glass substrate 5 using $SnO_2$ or ITO in accordance with conventional methods known to those having ordinary skill in the art. The transparent electrodes are usually formed with $SnO_2$ or ITO. They can be formed by ion sputtering, ion plating, chemical vapor deposition, or an electrodeposition technique. Such transparent electrode structures and forming methods are well known in the field of AC PDP technology.

Figure 2A:
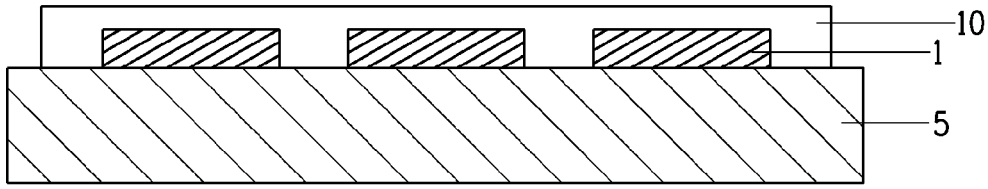

The conductive composition for black bus electrodes in the invention is then used to apply an electrode paste layer 10, and the black electrode paste layer 10 is then dried in nitrogen or the air (FIG. 2A).

Figure 2B:
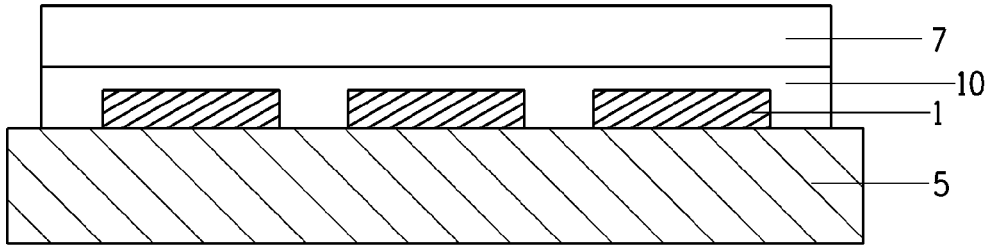

A photosensitive thick film conductor paste 7 for forming the white electrodes is then applied on the black electrode paste layer 10. The white electrode paste layer 7 is then dried in nitrogen or the air (FIG. 2B).

The white electrode paste used in the invention can be a well known or commercially available photosensitive thick film conductor paste. Desirable pastes for use in the invention may contain silver particles, glass powder, photoinitiators, monomers, organic binders, and organic solvents. The silver particle configuration may be random or thin flakes, preferably with a particle diameter of 0.3 to 10 μm. The glass powder, photoinitiator, monomer, organic binder, and organic solvent components can be of the same material as those used in the composition for the black bus electrodes. However, the amounts of the components will differ considerably. The amount in which the conductive silver particles are blended in particular will be greater in the white electrode paste, such as about 50 to 90 wt %, based on the total weight of the paste.

Figure 2C:
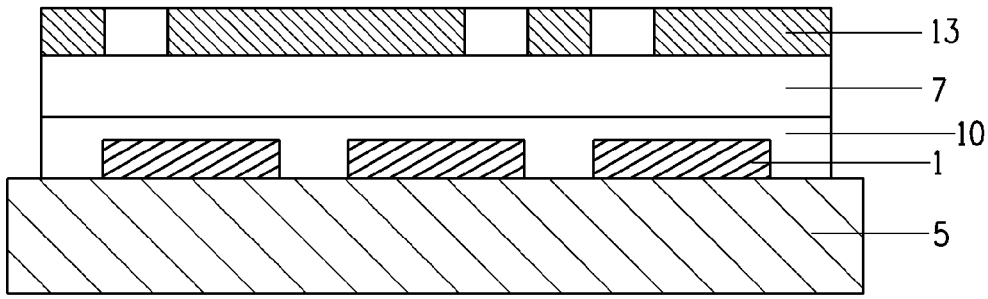

The black electrode paste layer 10 and white electrode paste layer 7 are exposed to light under conditions ensuring the formation of the proper electrode patterns after development. During the exposure to light, the material is usually exposed to UV rays through a target 13 or photo tool having a configuration corresponding to the pattern of the black bus electrodes and white electrodes (FIG. 2C).

Figure 2D:
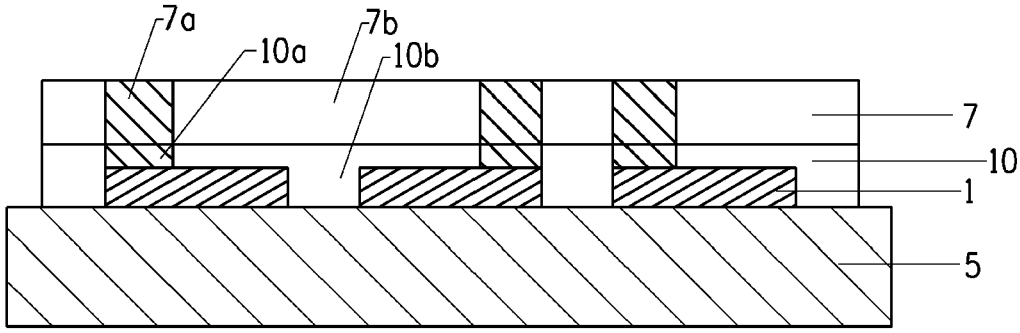

The parts (10*a*, 7*a*) of the black electrode paste layer 10 and white electrode paste layer 7 that have been exposed to light are developed in a basic aqueous solution such as 0.4 wt % sodium carbonate aqueous solution or another alkaline aqueous solution. In this process, the parts (10*b*, 7*b*) of the layers 10 and 7 that have not been exposed to light are removed. The parts 10*a* and 7*a* that have been exposed to light remain (FIG. 2D). The patterns after development are then formed.

Figure 2E:
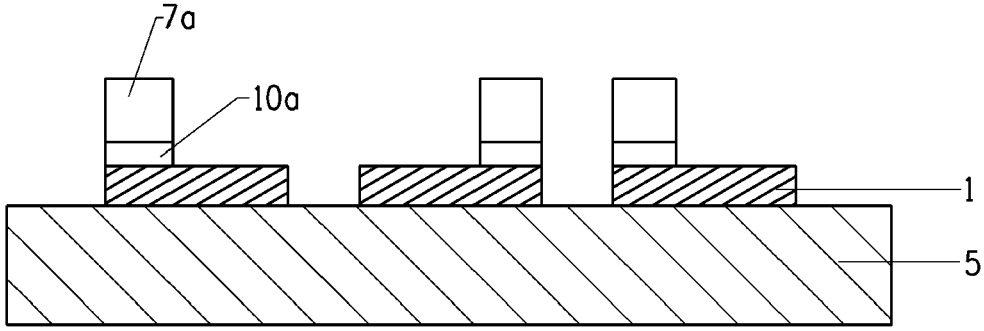

The material that has been formed is sintered at a temperature of 450 to 650° C. (FIG. 2E). At this stage, the glass powder melts and becomes firmly attached to the substrate. The sintering temperature is selected according to the substrate material. In the present invention, a precious metal-containing alloy is used as the conductive component of the black bus electrodes, and sintering can be done at about 600° C. As noted above, the reason is to ensure vertical conduction in PDP black bus electrodes. Sintering at lower temperature is also preferred because sintering at elevated temperatures tends to result in greater Ag diffusion.

The front panel glass substrate assembly produced by the method in FIG. 2 can be used in AC PDP. Returning to FIG. 1, for example, after the transparent electrodes 1, the black bus electrodes 10 and white electrodes 7 have been formed on the front panel glass substrate 5, the front glass substrate assembly is coated with a dielectric layer 8 and then an MgO layer 11. The front panel glass substrate 5 is then combined with a rear panel glass substrate 6.

The conductive composition of the present invention can also be used to form black stripes in a PDP. Attempts to form the black stripes and black bus electrodes with the same composition have been proposed in order to simplify the manufacturing process (such as Japanese Laid-Open Patent Application 2004-063247), and the conductive composition of the invention can be employed in such a process.

EXAMPLES

The invention is illustrated in further detail below by examples. The examples are for illustrative purposes only, and are not intended to limit the invention.

(A) Test on the Effect of Ag—Pd Addition

1. Preparation of Organic Components

Texanol (2,2,4-trimethyl-1,3-pentanediol monoisobutyrate) as the organic solvent and an acrylic polymer binder having a molecular weight of 6,000 to 7,000 as the organic binder were mixed, and the mixture was heated to 100° C. while stirred. The mixture was heated and stirred until all of the organic binder had dissolved. The resulting solution was cooled to 75° C. EDAB (ethyl 4-dimethyl aminobenzoate), DETX (diethylthioxanthone), and Irgacure 907 by Chiba Specialty Chemicals were added as photoinitiators, and TAOBN (1,4,4-trimethyl-2,3-diazabicyclo[3,2,2]-non-2-ene-N,N-dixoide) was added as a stabilizer. The mixture was stirred at 75° C. until all the solids had dissolved. The solution was filtered through a 40 micron filter and cooled.

2. Preparation of Black Electrode Paste

A photocurable monomer consisting of 2.58 wt % TMPEOTA (trimethylolpropane ethoxytriacrylate) and 5.72 wt % Laromer® LR8967 (polyethyl acrylate oligomer) by BASF, and 0.17 wt % butyrated hydroxytoluene and 0.42 wt % malonic acid as a stabilizer, were mixed with 37.5 wt % of the above organic component in a mixing tank under yellow light, so as to prepare a paste. 12.67 wt % cobalt oxide ($Co_3O_4$) as the black pigment, conductive particles, and glass powder were then added to the organic component mixture. Ag—Pd alloy (e.g K8015-15 by Ferro: 85% silver/15% palladium powder) or Ag was used as the conductive particles. The amounts of the glass powder and the conductive particles varied between the different examples and comparative examples. The amounts used in the examples and comparative examples are given in Tables 1 and 2.

The entire paste was mixed until the particles of the inorganic material were wet with the organic material. The mixture was dispersed using a 3-roll mill. The resulting paste was filtered through a 30 μm filter. The viscosity of the paste at this point in time was adjusted with Texanol (organic component) to the ideal viscosity for printing.

3. Preparation of White Electrode Paste

A photocurable monomer consisting of TMPEOTA (trimethylolpropane ethoxytriacrylate), as well as 0.12 wt % butyrated hydroxytoluene (2,6-di-t-butyl-4-methylphenol, BHT), 0.11 wt % malonic acid, and 0.12 wt % BYK085 by BYK as the other organic components, were mixed with 24.19 wt % of the above organic component in a mixing tank under yellow light, so as to prepare a paste. Glass frit and 70 wt % spherical conductive particles of Ag powder were added as the inorganic materials to the mixture of organic components. The entire paste was mixed until the particles of the inorganic material were wet with the organic material. The mixture was dispersed using a 3-roll mill. The resulting paste was filtered through a 30 μm filter. The viscosity of the paste at this point in time was adjusted with the above Texanol solvent to the ideal viscosity for printing.

4. Preparation of Electrodes

Precautions were taken to avoid dirt contamination, as contamination by dirt during the preparation of the paste and the manufacture of the parts would have resulted in defects.

4-1: Formation of Black Bus Electrodes

The black electrode paste was applied to a glass substrate by screen printing using a 200 to 400 mesh screen. Suitable screen and viscosity of the black electrode paste was selected, to ensure the desired film thickness was obtained. The paste was applied on a glass substrate on which transparent electrodes (thin film ITO) had been formed. The paste was then dried for 20 minutes at 100° C. in a hot air circulating furnace, so as to form black bus electrodes having a dried film thickness of 4.5 to 5.0 μm.

4-2: Formation of White Electrodes

The white electrode paste was applied by screen printing using a 400 mesh screen so as to cover the black electrodes. This was again dried for 20 minutes at 100° C. The thickness of the dried double-layered structure was 12.5 to 15 μm.

4-3: UV Ray Pattern Exposure

The double-layered structure was exposed to light through a photo tool using a collimated UV radiation source (illumination: 18 to 20 mW/cm$^2$; exposure: 200 mj/cm$^2$).

4-4: Development

An exposed sample was placed on a conveyor and then placed in a spray developing device filled with 0.4 wt % sodium carbonate aqueous solution as the developer. The developer was kept at a temperature of 30° C., and was sprayed at 10 to 20 psi. The sample was developed for 12 seconds. The developed sample was dried by blowing off the excess water with an air jet.

4-5: Sintering

A peak temperature of 590° C. was reached (first sintering) by sintering in a belt furnace in air using a 1.5 hour profile.

4-6: TOG Coating

TOG paste was then screen printed using a 150 stainless steel mesh screen. This was again dried for 20 minutes at 100° C. Sintering (second sintering) was done at a peak temperature of 580° C. in a belt furnace in air using a 2.0 hour profile.

5. Evaluation 5-1: L Value

After the sintering, the degree of blackness as viewed from the rear panel of the glass substrate was determined. To determine the degree of blackness, colors (L*, a*, b*) were determined using a device by Nippon Denshoku. A standard white plate was used for calibration at this time. L* indicates the brightness, a* indicates red and green, and b* indicates yellow and blue. An L*- of 100 indicates pure white, and 0 indicates pure black. The higher the numerical value of a*, the redder the color. The higher the numerical value of b*, the yellowier the color.

5-2: Contact Resistance (Ω)

The resistance between adjacent electrode patterns was determined by the 4-terminal method using an R6871E by Advantest. What was measured here was the contact resistance, which is an important element for black bus electrodes. In other words, in black bus electrodes, the value is the resistance in the direction in which the electrodes are stacked, which is the direction in which the current flows.

5-3: Data Analysis

As shown in Tables 1 and 2, very good contact resistance could be achieved using Ag—Pd alloy as the conductive particles. Ag—Pd afforded excellent conductivity in the vertical direction required in black bus electrodes, and resulted in satisfactory conduction when added in small amounts. For example, the same amount of conductive particles was added in Example 3 and Comparative Example 1, but the contact resistance (first sintering) was 5.1Ω when Ag—Pd was used, whereas the contact resistance (first sintering) was 55.8Ω when Ag was used.

Furthermore, an unexpected result was the behavior after the TOG sintering process. A comparison of the contact resistance at the first sintering and contact resistance at the second sintering revealed deterioration of the contact resistance after the TOG sintering process when Ag was used. On the other hand, when an Ag—Pd alloy was used, the trend was exactly the opposite, as evidenced in Examples 1 through 9. In other words, contact resistance which originally had excellent numerical values fell even lower after the TOG sintering process.

It was thus evident that the numerical figures for the L value were sufficiently satisfactory for products when Ag—Pd alloy was used.

Although not shown in Tables 1 and 2, the use of Ag as conductive particles resulted in pronounced yellowing as a result of the diffusion of the Ag in black stripes in particular. This was attributed to the absence of ITO electrodes in the black stripe portions, as Ag diffusion can be controlled to a certain extent by the presence of ITO electrodes. Taking this into consideration, the present invention should be extremely significant when black stripes and black bus electrodes are formed with the same composition in order to simplify the manufacturing process.

TABLE 1

| | | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|---|
| Conductive powder | Material used | Ag—Pd alloy | Ag—Pd alloy | Ag—Pd alloy | Ag—Pd alloy | Ag—Pd alloy | Ag—Pd alloy | Ag—Pd alloy | Ag—Pd alloy | Ag—Pd alloy |
| | d50 (μm) | 1.4 | 1.4 | 1.4 | 1.4 | 1.4 | 1.4 | 1.4 | 1.4 | 0.4 |
| | Content (wt %) | 0.1 | 0.25 | 0.5 | 1.0 | 2.0 | 3.0 | 5.0 | 7.0 | 0.5 |
| Glass powder | Content (wt %) | 32.76 | 32.61 | 32.36 | 31.86 | 30.86 | 29.86 | 27.86 | 25.86 | 32.36 |
| Organic components | Content (wt %) | 45.58 | 45.58 | 45.58 | 45.58 | 45.58 | 45.58 | 45.58 | 45.58 | 45.58 |
| Black pigment | Content (wt %) | 12.67 | 12.67 | 12.67 | 12.67 | 12.67 | 12.67 | 12.67 | 12.67 | 12.67 |
| Photocurable monomer | Content (wt %) | 8.3 | 8.3 | 8.3 | 8.3 | 8.3 | 8.3 | 8.3 | 8.3 | 8.3 |
| Stabilizer | Content (wt %) | 0.59 | 0.59 | 0.59 | 0.59 | 0.59 | 0.59 | 0.59 | 0.59 | 0.59 |
| Total | | 100.00 | 100.00 | 100.00 | 100.00 | 100.00 | 100.00 | 100.00 | 100.00 | 100.00 |
| L* | | 7.2 | 7.5 | 8 | 9.8 | 12.8 | 14.8 | 18.6 | 20.3 | 8 |
| a* | | −0.6 | −0.4 | −0.3 | −0.1 | 0.2 | 0.5 | 0.8 | 1.1 | −0.4 |
| b* | | 0.8 | 0.8 | 1.1 | 1.9 | 2.9 | 3.3 | 3.9 | 3.9 | 0.9 |
| Contact resistance (first sintering) | (Ω) | 12.8 | 7.5 | 5.1 | 3.5 | 2.7 | 2.4 | 2.1 | 2.0 | 13.6 |
| Contact resistance (second sintering) | (Ω) | 4.2 | 2.6 | 2.1 | 1.8 | 1.5 | 1.5 | 1.4 | 1.5 | 7.0 |

TABLE 2

| | | Comp. Ex. 1 | Comp. Ex. 2 | Comp. Ex. 3 | Comp. Ex. 4 |
|---|---|---|---|---|---|
| Conductive powder | Material used | Ag | Ag | Ag | None added |
| | d50 (μm) | 1.9 | 1.9 | 1.9 | |
| | Content (wt %) | 0.5 | 2.0 | 5.0 | |
| Glass powder | Content (wt %) | 32.36 | 30.86 | 27.86 | 32.86 |
| Organic components | Content (wt %) | 45.58 | 45.58 | 45.58 | 45.58 |
| Black pigment | Content (wt %) | 12.67 | 12.67 | 12.67 | 12.67 |
| Photocurable monomer | Content (wt %) | 8.3 | 8.3 | 8.3 | 8.3 |
| Stabilizer | Content (wt %) | 0.59 | 0.59 | 0.59 | 0.59 |
| Total | | 100.00 | 100.00 | 100.00 | 100.00 |
| L* | | 6.9 | 8 | 12.2 | 6.9 |
| a* | | −0.4 | −0.5 | −0.4 | −0.4 |
| b* | | 0.4 | 0.7 | 1.4 | 0.4 |
| Contact resistance (first sintering) | (Ω) | 55.8 | 23.8 | 10.8 | 130.2 |
| Contact resistance (second sintering) | (Ω) | 142 | 88 | 36 | 293 |

Figure 4:
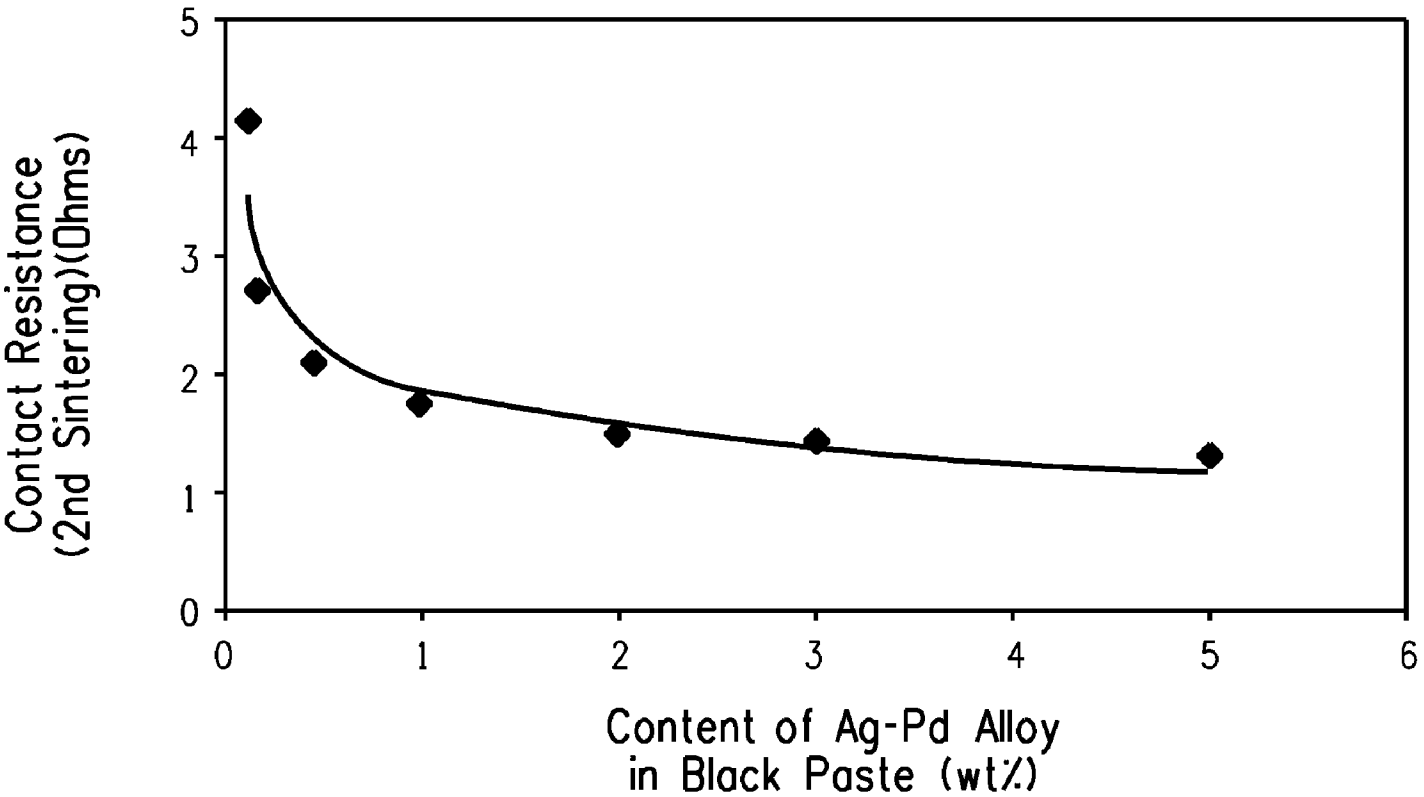
FIG. 4 is a graph showing relationship between the content of Ag—Pd alloy and contact resistance.

The relationship between the content of Ag—Pd alloy and contact resistance is shown in Table 1 and FIG. 4. As shown, the higher the content of Ag—Pd, the smaller the contact resistance. Small amounts of Ag—Pd could effectively decrease the contact resistance. In actual product, the preferred content of Ag—Pd is determined by considering both the contact resistance and the material price of Ag—Pd alloy.

(B) Test on the Effect of Other Alloy Addition

Other alloys were evaluated using the similar process of "(A) Test on the effect of Ag—Pd addition". As shown in Table 3, very good contact resistance could be achieved using various precious metal-containing alloy as the conductive particles. The used alloy afforded excellent conductivity in the vertical direction required in black bus electrodes, and resulted in satisfactory conduction when added in small amounts.

Furthermore, the unexpected result, which was confirmed in case of Ag—Pd alloy, was confirmed after the TOG sintering process. When the alloy of the present invention was used, contact resistance which originally had excellent numerical values fell even lower after the TOG sintering process. In example 10 where the content of Pt is 1 wt % based on total weight of alloy, contact resistance after 2nd sintering increased. However, the degree of increase was much smaller as compared with Ag 100% sample (comparative example 5).

It was thus evident that the numerical figures for the L value were sufficiently satisfactory for products when the present invention was used.

TABLE 3

| | | Ex. 10 | Ex. 11 | Ex. 12 | Ex. 13 | Ex. 14 | Ex. 15 | Ex. 16 | Comp. Ex. 5 |
|---|---|---|---|---|---|---|---|---|---|
| Conductive powder | Alloy | Ag/Pt | Ag/Pt | Ag/Pd/Pt | Ag/Pd/Pt | Ag/Pd/Pt | Pd/Pt | Pd/Pt | Ag |
| | Wt % Ratio | 99/1 | 90/10 | 94/5/1 | 89/10/1 | 85/14/1 | 50/50 | 50/50 | 100% |
| | d50 (μm) | 0.9 | 0.8 | 1.5 | 1.2 | 1.4 | 0.6 | 0.6 | 1.9 |
| | Content (wt %) | 0.25 | 0.25 | 0.25 | 0.25 | 0.25 | 0.25 | 0.25 | 0.25 |
| Glass powder | Content (wt %) | 31.13 | 31.13 | 31.13 | 31.13 | 31.13 | 31.13 | 31.13 | 31.13 |
| Organic components | Content (wt %) | 47.41 | 47.41 | 47.41 | 47.41 | 47.41 | 47.41 | 47.41 | 47.41 |
| Black pigment | Content (wt %) | 12.16 | 12.16 | 12.16 | 12.16 | 12.16 | 12.16 | 12.16 | 12.16 |
| Photocurable monomer | Content (wt %) | 8.63 | 8.63 | 8.63 | 8.63 | 8.63 | 8.63 | 8.63 | 8.63 |
| Stabilizer | Content (wt %) | 0.42 | 0.42 | 0.42 | 0.42 | 0.42 | 0.42 | 0.42 | 0.42 |
| Total | | 100 | 100 | 100 | 100 | 100 | 100 | 100 | 100 |
| L* | | 6.4 | 6.4 | 6.6 | 6.9 | 7 | 8.8 | 10.3 | 6.9 |

TABLE 3-continued

| | | Ex. 10 | Ex. 11 | Ex. 12 | Ex. 13 | Ex. 14 | Ex. 15 | Ex. 16 | Comp. Ex. 5 |
|---|---|---|---|---|---|---|---|---|---|
| a* | | −0.5 | −0.5 | −0.5 | −0.5 | −0.5 | −0.2 | −0.4 | −0.4 |
| b* | | 0.6 | 0.5 | 0.6 | 0.8 | 0.8 | 1.5 | 2.1 | 0.7 |
| Contact resistance (first sintering) | (Ω) | 108 | 79 | 41 | 13 | 11 | 5.2 | 3.4 | 101 |
| Contact resistance (second sintering) | (Ω) | 155 | 25 | 9.9 | 3 | 2.7 | 2.5 | 1.7 | 254 |

(C) Test on the Effect of Content of Pd in Ag—Pd Alloy

Figure 5:
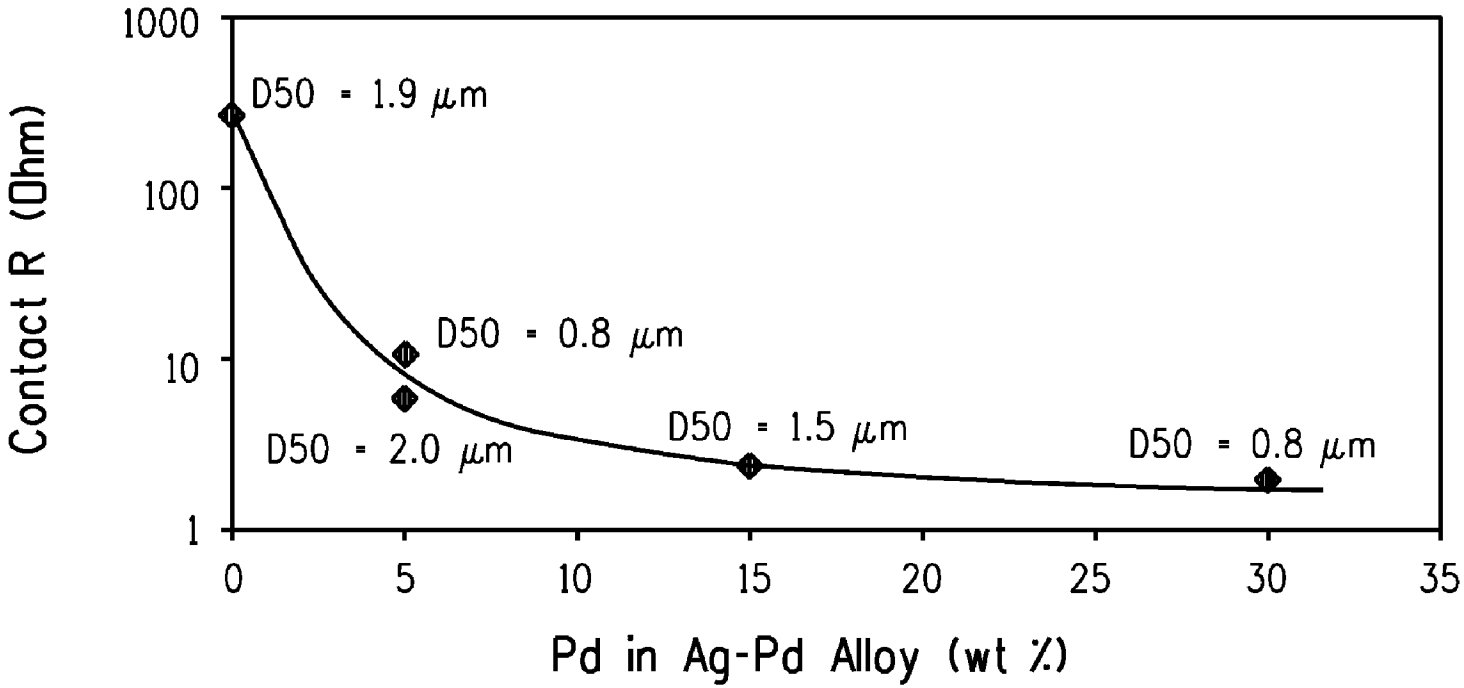
FIG. 5 is a graph showing relationship between the content of Pd in Ag—Pd alloy and contact resistance.

For the purpose of evaluating the relationship between the content of Pd in Ag—Pd alloy and contact resistance, several types of electrodes were manufactured following the above procedure. The result is shown in Table 4 and FIG. 5. As shown, the higher the content of Pd in the Ag—Pd alloy, the lower the contact resistance. In actual product, the content of Pd is preferred to be determined by considering both the contact resistance and the material price of Pd.

TABLE 4

| Pd in Ag—Pd alloy (wt %) | Contact resistance (Ω) |
|---|---|
| 0 | 254 |
| 5 | 10.7 |
| 5 | 5 |
| 15 | 2.1 |
| 30 | 1.9 |

What is claimed is:

1. A conductive composition for a black bus electrode for plasma display, comprising a conductive powder, glass powder, organic binder, organic solvent, and black pigment, wherein the conductive powder comprises an alloy of at least two metals selected from the group consisting of Ru, Rh, Pd, Ag, Os, Ir, Pt and Au, wherein the conductive powder is 0.01 to 5 wt %, the glass powder is 10 to 50 wt %, and the black pigment is 6 to 20 wt %, based on the total amount of the composition.

2. The conductive composition for a black bus electrode according to claim 1, wherein a mean particle diameter (PSD $D_{50}$) of the conductive powder is 0.1 to 5 μm.

3. The conductive composition for a black bus electrode according to claim 1, wherein the conductive powder comprises Ag—Pd alloy.

4. The conductive composition for a black bus electrode according to claim 3, wherein the Ag—Pd alloy contains 5 to 30 wt % of Pd based on the total weight of the Ag—Pd alloy.

5. The conductive composition for a black bus electrode according to claim 1, wherein the conductive powder comprises Ag—Pt alloy, Ag—Pt—Pd alloy or Pt—Pd alloy.

6. The conductive composition for a black bus electrode according to claim 1, comprising $Co_3O_4$ (tricobalt tetroxide) as the black pigment.

7. The conductive composition for a black bus electrode according to claim 1, further comprising a photopolymerization initiator and monomer.

8. A front panel of a plasma display panel on which bus electrodes are formed, wherein the bus electrodes have a black-and-white double-layered structure comprising a black electrode and a white electrode, and wherein the black electrode, prior to firing, comprises the composition of claim 1.

9. The front panel of a plasma display panel according to claim 8, wherein the conductive composition comprises Ag—Pd alloy, Ag—Pt alloy, Ag—Pt—Pd alloy or Pt—Pd alloy as a conductive component.

10. The front panel of a plasma display panel according to claim 8, wherein the black electrode comprises $Co_3O_4$ (tricobalt tetroxide) as black pigment.

* * * * *